United States Patent [19]

Graffin

[11] Patent Number: 5,069,366

[45] Date of Patent: Dec. 3, 1991

[54] ASEPTIC VOLUMETRIC PACKAGING APPARATUS

[75] Inventor: Jean-Jacques Graffin, La Chapelle Du Bois, France

[73] Assignee: Ets. A. Bertaud, Vitrolles, France

[21] Appl. No.: 479,846

[22] Filed: Feb. 14, 1990

[30] Foreign Application Priority Data

Feb. 14, 1989 [FR] France ..... 89 01880

[51] Int. Cl.[5] ..... B67D 1/08

[52] U.S. Cl. ..... 222/152; 222/255; 222/380; 422/33; 417/519

[58] Field of Search ..... 222/148, 372, 380, 554, 222/255, 152; 137/240, 241; 422/26, 27, 28, 33; 417/519

[56] References Cited

U.S. PATENT DOCUMENTS

| | | | |
|---|---|---|---|
| 4,273,263 | 6/1981 | Voegele et al. | 222/372 X |
| 4,350,187 | 9/1982 | Trusselle et al. | 222/148 X |
| 4,623,516 | 11/1986 | Weiler et al. | 422/28 |
| 4,676,279 | 6/1987 | Lersner . | |
| 4,699,297 | 10/1987 | Raque . | |
| 4,759,695 | 7/1988 | Bordini | 417/519 |
| 4,823,988 | 4/1989 | Raque | 222/148 |

FOREIGN PATENT DOCUMENTS

| | | | |
|---|---|---|---|
| 2308689 | 9/1974 | Fed. Rep. of Germany | 222/148 |
| 2603554 | 3/1988 | France . | |

*Primary Examiner*—Michael S. Huppert
*Assistant Examiner*—Gregory L. Huson
*Attorney, Agent, or Firm*—Griffin Branigan & Butler

[57] ABSTRACT

A packaging apparatus for aseptic volumetric packaging has a fixed means for forming a flow of sterile air to the apparatus, a feed member, at least one pumping member which is movable relative to the flow of sterile air, at least one filler spout and at least one dispenser member attached to the pumping member and the filler spout and disposed so as to be alternatable between positions connecting the feed member to the pumping member and the pumping member to the filler spout. The pumping member comprising a cylinder connected to the dispenser member, a piston mounted to slide inside the cylinder, a drive rod fixed to the piston and connected to an actuator device, and an enclosure fed with sterile air and mounted adjacent the cylinder. The enclosure surrounds the drive rod of the piston and is fed with sterile air from the flow of sterile air by a fan member associated with the pumping member. The fan member moves together with the pumping member and has an intake orifice disposed in the flow of sterile air.

3 Claims, 1 Drawing Sheet

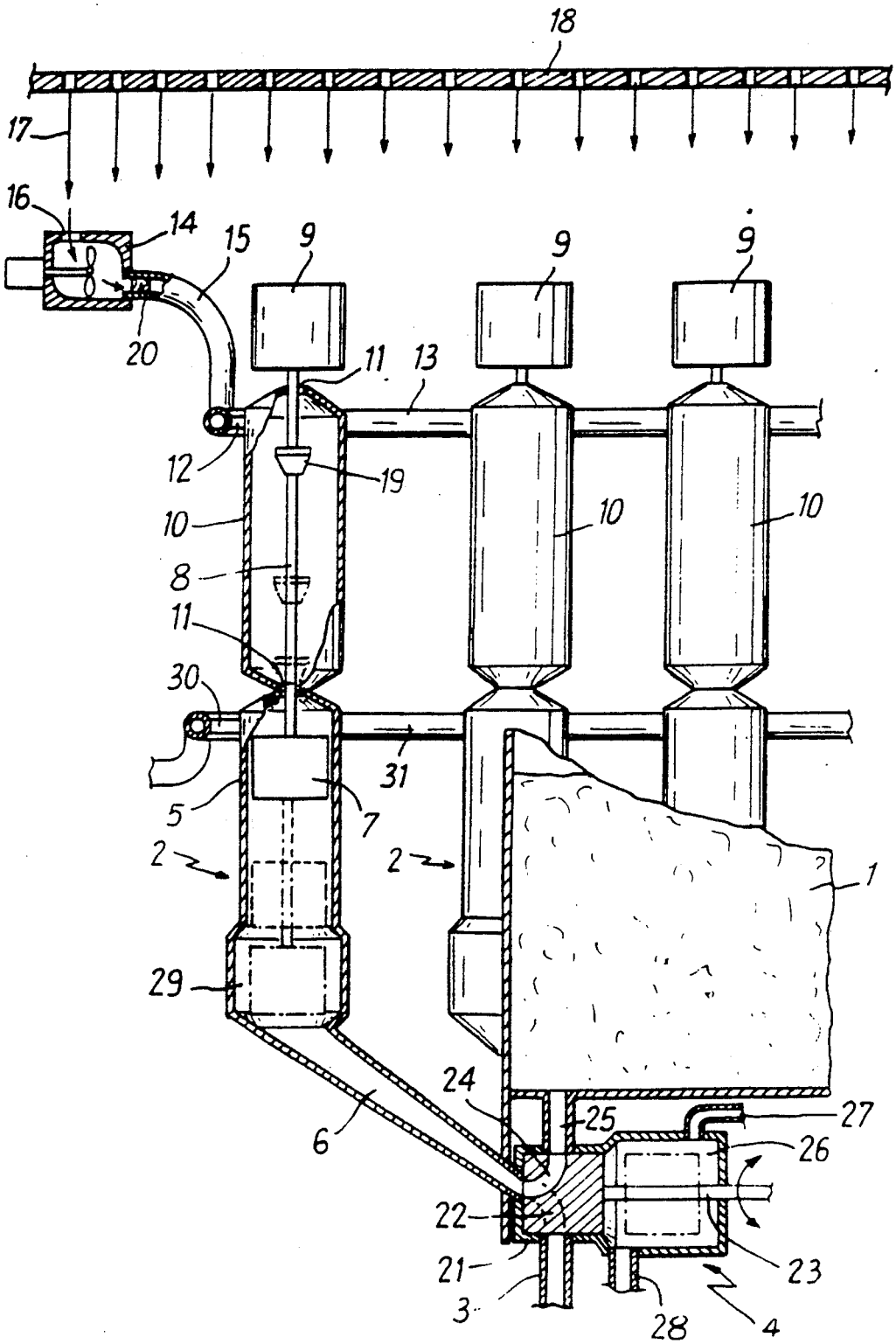
18
17
16
14
15
9
9
9
20
11
13
12
19
10
10
10
8
11
30
31
5
7
2
2
1
29
24
25
27
26
6
22
21
23
3
28
4

ASEPTIC VOLUMETRIC PACKAGING APPARATUS

The present invention relates to aseptic volumetric packaging apparatus.

BACKGROUND OF THE INVENTION

Fluid substances, be they liquid or semi-liquid, may be packaged by volume or by weight. It is generally preferred to package small volumes of heterogeneous substances by volume.

In general, volumetric packaging apparatus comprises a feed member, at least one positive displacement pumping member, at least one filler spout, and at least one dispenser member disposed so as to alternate between connecting the feed member to the pumping member and connecting the pumping member to the filler spout, the pumping member comprising a cylinder connected to the dispenser member, a piston mounted to slide inside the cylinder, and a drive rod fixed to the piston and connected to an actuator device.

When the substance is to be packaged aseptically, it is general practice to equip the pistons with piston rings and to supply the volume above the piston with a sterilizing liquid, generally sterile water with a bactericide. Since the piston rings can never provide perfect sealing, there is a danger of the sterilizing substance getting into the substance to be packaged during operation, and this poses problems of compatibility between the sterilizing substance and the substance to be packaged.

An object of the invention is to provide aseptic volumetric packaging apparatus in which there is no risk of the substance to be packaged being polluted in operation.

In addition, when the packaging apparatus includes a series of filler spouts mounted to move with the hopper, it is necessary when a sterilizing liquid is disposed above the pistons, for the sterilizing liquid to be conveyed by fixed pipework connected to the pistons via rotary seals which are complex and expensive.

Another object of the invention is to provide aseptic volumetric packaging apparatus having a simple structure for establishing a sterile barrier for a series of filler spouts.

SUMMARY OF THE INVENTION

In order to achieve the first object, the invention provides volumetric packaging apparatus of the type described above in which an enclosure fed with sterile air is mounted adjacent to the pump cylinder and surrounds the drive rod of the piston over a length which is not less than the pumping stroke of the piston inside the cylinder.

Thus, on each stroke of the piston, the driving portion of the rod that must penetrate into the pump cylinder is constantly maintained in a sterile environment. The sterile barrier normally provided at the piston is thus omitted and it is even possible to make use of a piston having no piston ring and sliding inside the cylinder with a very small amount of clearance, since the substance being pumped is generally sufficiently viscous not to rise over the piston.

In an advantageous version of the invention, in which the packaging apparatus includes means for forming a flow of sterile air, each sealed enclosure surrounding the drive rod of a piston is fed with sterile air by at least one fan member having an intake orifice disposed in the flow of sterile air. This makes maximum use of the existing structure of the packaging apparatus for establishing a sterile barrier at the positive displacement pumping member.

In a preferred aspect of the invention where the packaging apparatus includes a series of filler spouts and pumping members mounted to move with the hopper relative to the means for forming the flow of sterile air, the fan member is associated with the pumping members in order to move therewith. Thus, the fan member moves in the flow of sterile air and takes the air it requires therefrom in order to feed the sealed enclosure without it being necessary to provide rotary seals.

In another advantageous aspect of the invention, the cylinder includes a washing chamber beyond an extreme pumping position adjacent to the dispenser member, the dimensions of the washing chamber being greater than those of the piston. Thus, when the machine is cleaned, the cylinder, the piston, and the drive rod are cleaned and sterilized simultaneously and without being disassembled by bringing the piston into the washing chamber and by injecting a washing fluid into the cylinder.

In yet another advantageous aspect of the invention applicable to packaging apparatus in which the dispenser member is a plug valve comprising a housing having a plug disposed therein and connected to control means, the housing includes a sterile chamber adjacent to the plug and including sterile air flow means, said chamber being disposed on one side of the plug such that the sterile air exerts a force on the plug, holding it in its operating position. It is preferable for the dimensions of the sterile chamber, at least transversely to the axis of rotation of the plug, to be greater than those of the plug. Thus, the sterile air flowing in the sterile chamber serves not only to maintain the plug in position, but also forms a sterile barrier on the side thereof. Further, during cleaning, the plug may be shifted into the sterile chamber and the entire dispenser member and sterile chamber may be cleaned and sterilized by passing a cleaning fluid therethrough and without being disassembled.

BRIEF DESCRIPTION OF THE DRAWING

An embodiment of the invention is described by way of example with reference to the sole figure of the accompanying drawing which is a diagrammatic elevation view partially in section on a vertical plane through a portion of packaging apparatus of the invention.

DETAILED DESCRIPTION

With reference to the figure, the aseptic volumetric packaging apparatus of the invention includes a hopper 1 associated with a frame (not shown) for rotating relative thereto.

Positive displacement pumping members generally designated 2 are disposed around the hopper in order to rotate together therewith, and they are connected to the hopper 1 and to filler spouts 3 by 3-way dispenser members generally designated 4.

Each of the positive displacement pumping members comprises a cylinder 5 fixed at its bottom end to the dispenser member 4 via a duct 6, and a piston 7 mounted to slide without a piston ring inside the cylinder 5. The piston 7 is displaced inside the cylinder by a drive rod 8 which is fixed to the piston and connected to an actuator device 9, e.g. an electric stepper motor driven by pulses from a control platen receiving information from an incremental encoder. The drive rod could alternatively include a rack driven by a pinion having its axis extending perpendicularly to the drive axis.

An enclosure 10 is disposed adjacent to the pump cylinder 5 and has the drive rod 8 passing therethrough, said enclosure surrounding the drive rod over a length not less than the pumping stroke of the piston 7 inside the cylinder 5. Where the drive rod 8 passes through the wall of the enclosure 10, the enclosure includes exhaust openings 11 which surround the drive rod 8. The enclosure 10 is fed with sterile air by a feed duct 12 opening out into the enclosure and connected to a manifold 13, e.g. a circular manifold surrounding the entire set of sealed enclosures 10. The manifold 13 is itself connected to a fan member 14 via a duct 15 which includes a filter 20, if necessary. The fan member 14 includes an air intake orifice 16 disposed in a flow of sterile air illustrated by arrows 17 and generated by sterile air flow forming means, e.g. a perforated ceiling 18 fixed to the frame of the packaging apparatus and appropriately fed with sterile air in order to keep the moving portion of the packaging apparatus bathed in a laminar flow of sterile air.

According to another advantageous aspect of the invention, the dispenser members 4 are plug valves each comprising a housing 21 in which a plug 22 is disposed and connected to a control rod 23. In the embodiment shown, the plug 22 includes a curved link channel 24 having one end facing the bottom end of the channel 6 associated with the piston cylinder 5, and having its opposite end capable of facing either a take-off duct 25 associated with the hopper 1 (as shown in solid lines in the figure), or else facing a filler spout 3 as shown in dashed lines in the figure, with the angular position of the plug 22 being determined by the control rod 23. Adjacent to the plug 22, the valve 4 includes a sterile sealed chamber 26 connected to a sterile air feed duct 27 and to an air exhaust duct 28. If the configuration of the machine makes it possible, the sterile air feed duct 27 may be connected to the manifold 13 and the exhaust duct 28 may be connected to an exhaust manifold (not shown). The dimensions of the sterile chamber 26 are substantially greater than those of the plug 22 such that during cleaning, the plug 22 may be withdrawn into the sterile chamber while maintaining an empty space around the plug 22.

According to yet another advantageous aspect of the invention, the cylinder 5 of the pumping member has a washing chamber 29 at its bottom end with the inside dimensions of the washing chamber being greater than the dimensions of the piston 7. In addition, a non-return valve 19 is fixed on the drive rod 8 at a distance from the top face of the piston 7 to which the drive rod 8 is fixed equal to the distance between said top face and the bottom exhaust orifice 11 when the piston 7 is in the washing position inside the washing chamber 29, and the cylinder includes an orifice connected to a washing fluid injection channel 30. In practice, the injection channel 30 for each pump cylinder 5 is connected to a feed manifold 31 itself connected to a source of washing fluid (not shown).

The packaging apparatus of the invention operates as follows: while a substance contained in the hopper 1 is being packaged, sterile air is delivered by the fan device 14 into the enclosures 10 of the pumping members and into the sterile chambers 26 of the dispenser members. The air delivered into the chambers 10 immerses the drive rod 8 and escapes via the exhaust orifices 11. The air leaving via the top exhaust orifices return to the flow of sterile air, whereas the air flowing through the bottom exhaust orifices is exhausted via the channels 30 and the manifold 31. The piston 7 of each pump member is operated by its actuator device 9 to move between a high pumping position shown in solid lines in the figure and a low pumping position shown in dashed lines in the figure. The portion of the drive rod 8 extending between the piston 7 and the actuator device 9 is thus swept by a flow of sterile air such that any polluting particles which may be deposited on the drive rod 8 as it rises from the chamber 10 are swept off by the flow of sterile air. The portion of the drive rod 8 which extends into the pump cylinder 5 thus remains constantly under appropriate aseptic conditions. Simultaneously, the sterile air flow inside the sterile chambers 26 serves firstly to hold the plugs 22 in their operating positions, and also serves to sweep their control rods 23 such that any polluting particles are eliminated whether they come from the environment or from the drive member for each control rod 23.

When it is desired to wash and sterilize the packaging apparatus, the fan member 14 is stopped, the piston 7 is lowered to the position shown in dot-dashed lines in the figure inside the washing chamber 29. In this position the valve 19 closes the bottom exhaust orifice 11. In addition, the plug 22 is withdrawn into the sterile chamber in the position likewise shown by dot-dashed lines in the figure. In this position, a washing fluid, e.g. pressurized water or high temperature steam is delivered by the washing fluid feed duct 30. The washing fluid then flows through the pump cylinders 5 around the pistons 7 and passes through the various accessible orifices, cleaning both the inside surface of the housing 21 and the outside surfaces of the plug 22 and the inside surfaces of the sterile chambers 26.

Naturally the invention is not limited to the embodiment described and variants may be made thereto without going beyond the scope of the invention. In particular, although in the embodiment shown the plug valve is a cylindrical valve, the same structure could be achieved using a conical plug valve, in which case the sterile chamber would preferably be provided adjacent to the larger section end of the plug. In this case, it would suffice to withdraw the plug a little way in a direction parallel to its control rod in order to allow the cleaning fluid to flow around the plug.

The plug valve dispenser member could be replaced by some other 3-way dispenser member, for example a slide valve member.

Although the apparatus of the invention has been described having a feed member including an incorporated hopper, the feed member could also be made by a duct feed connected to an external hopper or even directly connected to means for producing the substance to be packaged. If a rotary carousel is used, then a rotary connection is required.

Further, the term "sterile air" is used to mean either air from which all polluting particles have been removed, or else purified air to which a sterilizing substance is added, e.g. a spray of hydrogen peroxide. When so preferred, in particular when the packaging apparatus is not fitted with a ceiling delivering a flow of sterile air, it is also possible to connect the chambers 10 to a filter device incorporated in the packaging apparatus and connected to an external source of non-sterile air via a rotary connection.

It is also possible to provide sealed enclosures 10 by placing seals in the exhaust openings 11. In such a case, there is no point in providing a valve body 19 on the drive rod 8, but it is necessary to provide an exhaust orifice in the wall of the enclosure 10, with the exhaust orifices from a plurality of enclosures being connected together via an exhaust manifold, if so required. It is also possible, if so desired, to inject the cleaning liquid via the filling spouts. The channels 30 and the manifold 31 are then used for exhausting the cleaning liquid.

I claim:

1. Packaging apparatus for aseptic volumetric packaging, the apparatus comprising fixed means for forming a flow of sterile air, a feed member, at least one pumping member mounted for moving relative to the flow of sterile air, at least one filler spout and at least one dispenser member attached to the pumping member and the filler spout and disposed so as to alternate between connecting the feed member to the pumping member, and the pumping member to the filler spout, the pumping member comprising a cylinder connected to the dispenser member, a piston mounted to slide inside the cylinder, a drive rod fixed to the piston and connected to an actuator device, and an enclosure fed with sterile air and mounted adjacent to the cylinder, said enclosure surrounding the drive rod of the piston and being fed by a fan member associated with the pumping member to move together therewith and having an intake orifice disposed in the flow of sterile air.

2. Packaging apparatus according to claim 1, including a series of pumping members with enclosures connected to a common manifold, said fan member being connected to said manifold.

3. Packaging apparatus according to claim 1, wherein the dispenser member is a plug valve including a housing in which a plug is disposed, the plug being connected to control means, the housing including a sterile chamber adjacent to the plug and fed by said fan member.

* * * * *